US007481751B1

(12) United States Patent
Arnold

(10) Patent No.: US 7,481,751 B1
(45) Date of Patent: Jan. 27, 2009

(54) ANKLE/LEG THERAPY DEVICE

(76) Inventor: Floyd Arnold, P.O. Box 10238, Murfreesboro, TN (US) 37130

( * ) Notice: Subject to any disclaimer, the term of this patent is extended or adjusted under 35 U.S.C. 154(b) by 0 days.

(21) Appl. No.: 11/745,631

(22) Filed: May 8, 2007

(51) Int. Cl.
*A63B 21/04* (2006.01)

(52) U.S. Cl. ..... 482/129; 482/79; 482/121; 482/904; 5/621; 5/624

(58) Field of Classification Search ..... 482/79, 482/80, 145, 146, 904, 121, 122, 125, 129, 482/130, 135, 139; 601/5, 23, 27, 29, 32, 601/34; 5/624, 651, 618, 619, 621, 658; 248/229.15, 229.25, 227.2, 228.6, 230.6, 248/231.71, 214, 372.1, 162.1, 274.1, 284.1
See application file for complete search history.

(56) References Cited

U.S. PATENT DOCUMENTS

| | | | | | |
|---|---|---|---|---|---|
| 1,509,793 | A | | 9/1924 | Thompson | |
| 1,948,534 | A | * | 2/1934 | Nelson et al. | 482/1 |
| 2,057,992 | A | * | 10/1936 | Wiruth | 5/650 |
| 2,067,891 | A | * | 1/1937 | Comper | 5/624 |
| 2,340,666 | A | | 2/1944 | Johanson | 272/58 |
| 2,645,482 | A | * | 7/1953 | Magida | 482/79 |
| 2,757,058 | A | * | 7/1956 | Broesel | 5/624 |
| 3,000,632 | A | * | 9/1961 | Fuchs | 482/97 |
| 3,020,909 | A | * | 2/1962 | Stevens | 602/39 |
| 3,143,110 | A | * | 8/1964 | Stryker | 602/39 |
| 3,355,163 | A | * | 11/1967 | Leinassar | 5/624 |
| 3,421,760 | A | * | 1/1969 | Freeman, Jr. | 482/80 |
| 3,524,643 | A | * | 8/1970 | Hazelitt, Sr. | 482/80 |
| 3,768,808 | A | * | 10/1973 | Passera | 482/114 |
| 3,887,180 | A | | 6/1975 | Berman | 272/58 |
| 3,893,197 | A | * | 7/1975 | Ricke | 5/651 |
| 3,967,334 | A | * | 7/1976 | Ricke et al. | 5/651 |
| 3,982,742 | A | * | 9/1976 | Ford | 5/649 |
| 4,169,591 | A | * | 10/1979 | Douglas | 482/58 |
| 4,474,176 | A | | 10/1984 | Farris et al. | 128/25 |
| 4,615,335 | A | * | 10/1986 | Searcy | 601/32 |
| 4,637,379 | A | | 1/1987 | Saringer | 128/25 |
| 4,733,859 | A | * | 3/1988 | Kock et al. | 482/79 |
| 4,782,827 | A | * | 11/1988 | Paratte | 602/35 |
| 4,809,687 | A | * | 3/1989 | Allen | 602/4 |
| 4,844,448 | A | * | 7/1989 | Niznik | 482/40 |
| 5,005,831 | A | * | 4/1991 | Hara | 482/129 |
| 5,170,776 | A | * | 12/1992 | Pecheux | 601/29 |

(Continued)

*Primary Examiner*—Loan H Thanh
*Assistant Examiner*—Daniel F Roland
(74) *Attorney, Agent, or Firm*—Brian S. Steinberger; Law Offices of Brian S. Steinberger, P.A.

(57) ABSTRACT

Devices, apparatus, systems and methods of providing therapy and exercise to the leg, ankle, and foot of a patient/occupant preferably laying down on a bed. The device can include a clamp that attaches about a footboard/headboard of a bed, with an elongated member extending out from the clamp. Pivotally attached to the end of the member can be a backward L-shaped bar, and a foot pad can be pivotally attached to the lower horizontal leg of the L-shaped bar. Springs can pull the top of the L-shaped bar toward the clamp. The user can push their foot and pivot the footpad so that the springably biased pivotally attached L-shaped bar constantly pushes back against the foot. The ankle can be rotated and the leg extended and the foot moved for therapy and exercise. An additional spring can hold the foot pad in a pivoted position so that an ankle can be further exercised.

2 Claims, 12 Drawing Sheets

U.S. PATENT DOCUMENTS

| | | | | | |
|---|---|---|---|---|---|
| 5,239,987 | A | * | 8/1993 | Kaiser et al. | 601/34 |
| 5,407,414 | A | * | 4/1995 | Bass | 482/129 |
| 5,540,641 | A | * | 7/1996 | Williams et al. | 482/114 |
| 5,582,379 | A | * | 12/1996 | Keselman et al. | 248/279.1 |
| 5,720,702 | A | * | 2/1998 | Lee | 482/129 |
| 5,800,323 | A | * | 9/1998 | Ansel | 482/129 |
| 6,110,078 | A | * | 8/2000 | Dyer | 482/79 |
| 6,206,807 | B1 | | 3/2001 | Cowans et al. | 482/79 |
| 6,270,445 | B1 | | 8/2001 | Dean, Jr. et al. | 482/4 |
| 6,709,369 | B1 | | 3/2004 | Jacobs | 482/80 |
| 6,872,186 | B2 | | 3/2005 | Branch et al. | 601/5 |
| 7,008,357 | B2 | | 3/2006 | Winkler | 482/142 |
| 7,303,513 | B1 | * | 12/2007 | Curtiss | 482/130 |
| 2002/0193210 | A1 | * | 12/2002 | Turner | 482/80 |
| 2004/0243028 | A1 | * | 12/2004 | Han | 601/34 |
| 2005/0251067 | A1 | | 11/2005 | Terry | 601/5 |
| 2006/0064044 | A1 | | 3/2006 | Schmehl | 601/34 |

* cited by examiner

Fig.11A
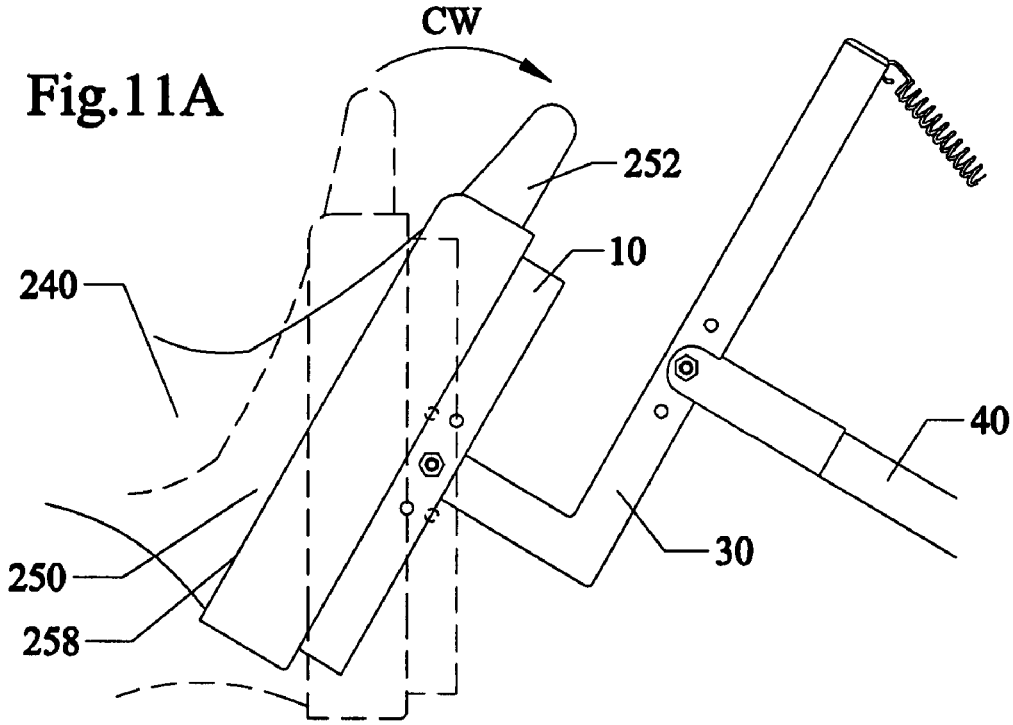
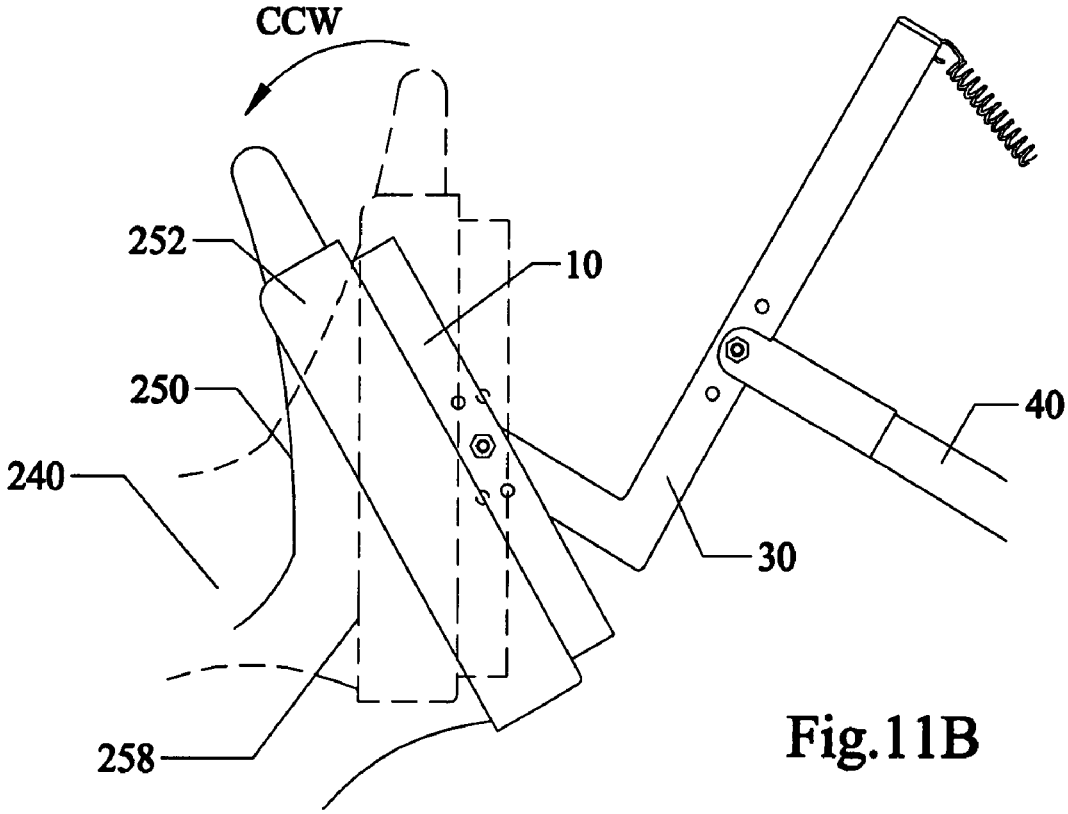
Fig.11B

ANKLE/LEG THERAPY DEVICE

This invention relates to therapy and exercise, in particular to devices, apparatus and methods of providing therapy and exercise treatments for muscles and tendons and nerves on feet, ankles and legs.

BACKGROUND AND PRIOR ART

Over the years, accidents and conditions such as arthritis have resulted in muscle, tendon and nerve damage to one's feet and ankles. Ankle type fractures have been treated by immobilizing the body part in a cast and the like, where removal after many weeks or months can result in other serious complications. For example, an immobilized patient can experience a loss of muscle tone that can include muscle atrophy as well as the threat of blood clots by constant immobilization. The sixty degrees of articulation that is required in one's ankle can be seriously effected by such immobilization. Thus, there is a need to provide therapy and exercise treatment to the body parts to allow for enhancing blood flow by moving the body parts so that the muscles, tendons and nerves properly heal.

Various types of devices have been proposed over the years for providing treatment to the lower extremities of the body. Some of these devices have required the body parts such as the lower legs and/or feet to be securely strapped in place. See for example, U.S. Pat. Nos. 1,509,793 to Thompson; 4,474,176 to Farris et al.; 6,206,807 to Cowan et al.; 6,709,369 to Jacobs; and U.S. Patent Application Publication 2006/0251067 to Terry. However, these devices are both cumbersome to use and require extra time to attach and remove from the patient that is not desirable for long term use.

Other devices have limited exercise and therapy capability since they fail to treat and articulate one's ankle. See for example, U.S. Pat. No. 3,887,180 to Berman.

Still other devices have been proposed that are complex, expensive, not easy to assemble and disassemble and not practical for use outside of a hospital, and cannot be easily used by most patients without a doctors prescription and/or a therapist to use. See for example, U.S. Pat. Nos. 2,340,666 to Johanson; 4,637,379 to Saringer; 6,270,445 to Dean, Jr. et al.; and U.S. Patent Application publication 2006/0064044 to Schmehl.

Many devices require the patient be in a sitting or prone position that can be both uncomfortable and also require the patient to control the device with one's hand which can require the patient to be in an uncomfortable position for long periods of time. See for example, U.S. Pat. No. 6,872,186 to Branch et al. as well as U.S. Pat. No. 6,206,807 to Cowans et al. Additionally, just sitting in a seated position does not allow for the legs to receive any therapy and exercise which is also not desirable, which can be the result of other devices such as U.S. Pat. No. 7,008,357 to Winkler.

Thus, the need exists for solutions to the above problems with the prior art.

SUMMARY OF THE INVENTION

A primary objective of the present invention is to provide a therapy and exercise apparatus, device and method for use with a bed and the like, for stimulating blood circulation in the lower extremities by movement of various muscles, tendons and joints, that can treat legs, ankles and feet of a patient.

A secondary objective of the present invention is to provide therapy and exercise apparatus, device and method for use, that is compact and easily adaptable for use with either a headboard or foot board on a bed, and can be easily installed and removed without any tools or loose fasteners.

A third objective of the present invention is to provide therapy and exercise apparatus, device and method for use, for one's lower leg, ankle and foot, that allows the patient to control the flexing and stretching pressures and tensions when being used.

A fourth objective of the present invention is to provide therapy and exercise apparatus, device and method for use, for allowing a patient to safely and effectively articulate their foot relative to their lower leg.

A fifth objective of the present invention is to provide therapy and exercise apparatus, device and method for use, for allowing a patient to control and adjust articulation of their foot relative to their lower leg.

A sixth objective of the present invention is to provide therapy and exercise apparatus, device and method for use, for allowing a patient to safely and effectively move and stimulate their ankle.

A seventh objective of the present invention is to provide therapy and exercise apparatus, device and method for use, for allowing a patient to safely and effectively move and stimulate their calf muscles.

An eighth objective of the present invention is to provide therapy and exercise apparatus, device and method for use, for allowing a patient to safely and effectively move and stimulate muscles and tendons in their feet.

A preferred embodiment has the device clamped to the headboard or footboard of a bed by a clamp so that a patient/user laying on the bed can use the device. The device can include a foot pad for fitting against the bottom of a foot, which can be pivotally attached to the bottom of a backward L-shaped bar. The top of the bar can have a spring which can be attached by two springs to the clamp. A mid-section of an upper part of the L-shaped bar can be pivotally attached to a rod, the opposite end of which is fixably attached to the clamp. The user/patient can exercise their ankle, foot and leg by pushing on the pivotal footpad which also allows the L-shaped bar to pivot against the rod while the springs constantly push back against the foot.

Further objects and advantages of this invention will be apparent from the following detailed description of the presently preferred embodiments which are illustrated schematically in the accompanying drawings.

BRIEF DESCRIPTION OF THE FIGURES

FIG. 11A is an enlarged view of a foot tip pushing forward pivoting the device footpad.

FIG. 11B is an enlarged view of a foot bottom pushing forward pivoting the footpad.

DESCRIPTION OF THE PREFERRED EMBODIMENTS

Figure 1:
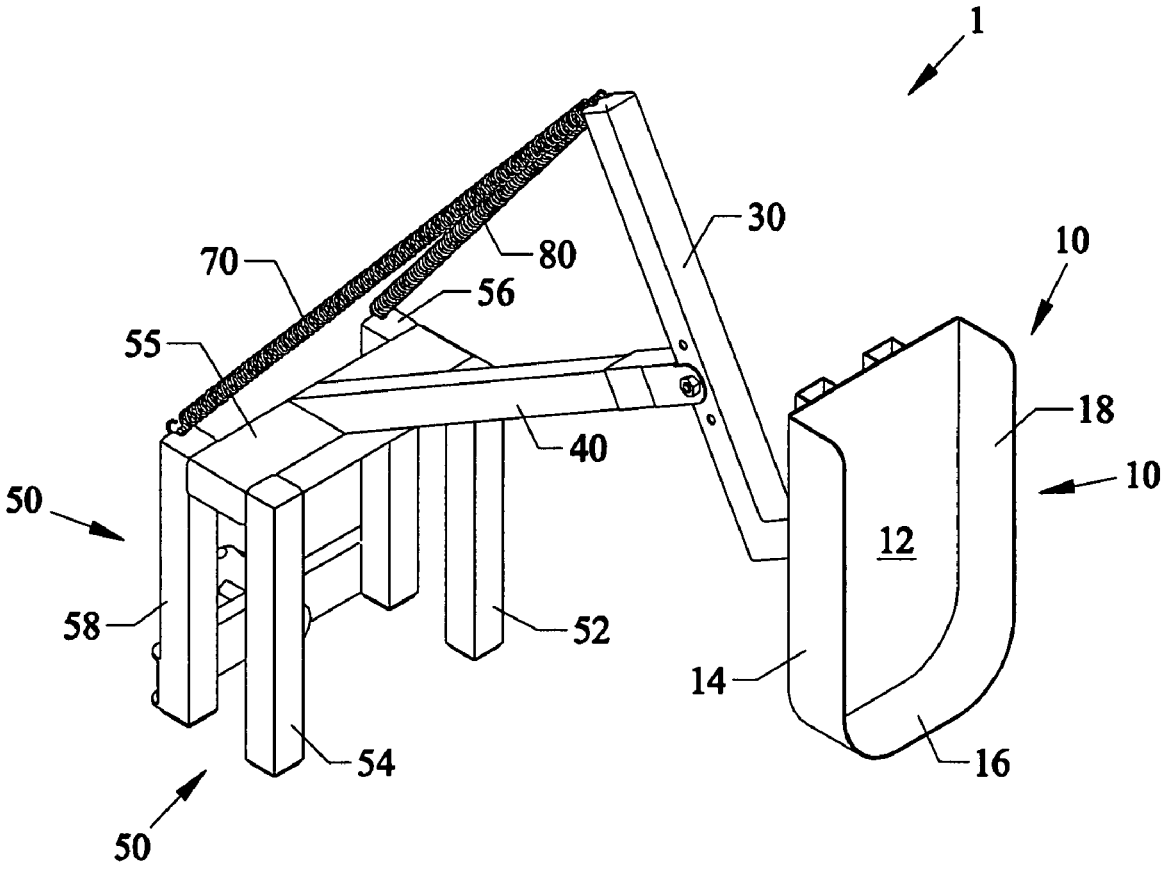
FIG. 1 is a perspective front footpad side view of the exercise and therapy device.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A description of the components will now be described.

Device 1
Cradle/footpad 10
Base plate 12
Left sidewall 14
Bottom curved wall 16
Right sidewall 18
First cradle bracket 22
Cradle back upper mounting holes 23
Cradle back pivoting bar and fasteners 25
Cradle back middle mounting holes 27
Cradle back lower mounting holes 29
Second cradle bracket 28
Backward L-shaped bar 30
Side leg upper mount hole 31
bottom leg 32
end of bottom leg 34
pivoting fastener 35
middle mount hole 35
side leg 36
middle of side leg 37
upper end of side leg 38
Side leg lower mount hole 39
Elongated member/bar 40
Upper end flanges of bar 42
Bottom of bar 48
Clamp 50
Front pair of downwardly protruding members 52, 54
Top of clamp 55
Rear pair of downwardly protruding members 56, 58
Clamp bar bracket 60
Turn knob 62
Screw head 64
First bar spring 70
Second bar spring 80
Footpad spring(s) 90
Bed 100
Footboard/headboard 110
User/patient 200
Upper leg of user 210
Knee 220
Lower leg 230
Ankle 240
Foot 250
Foot tip 252
Foot base/heel 258

Figure 2:
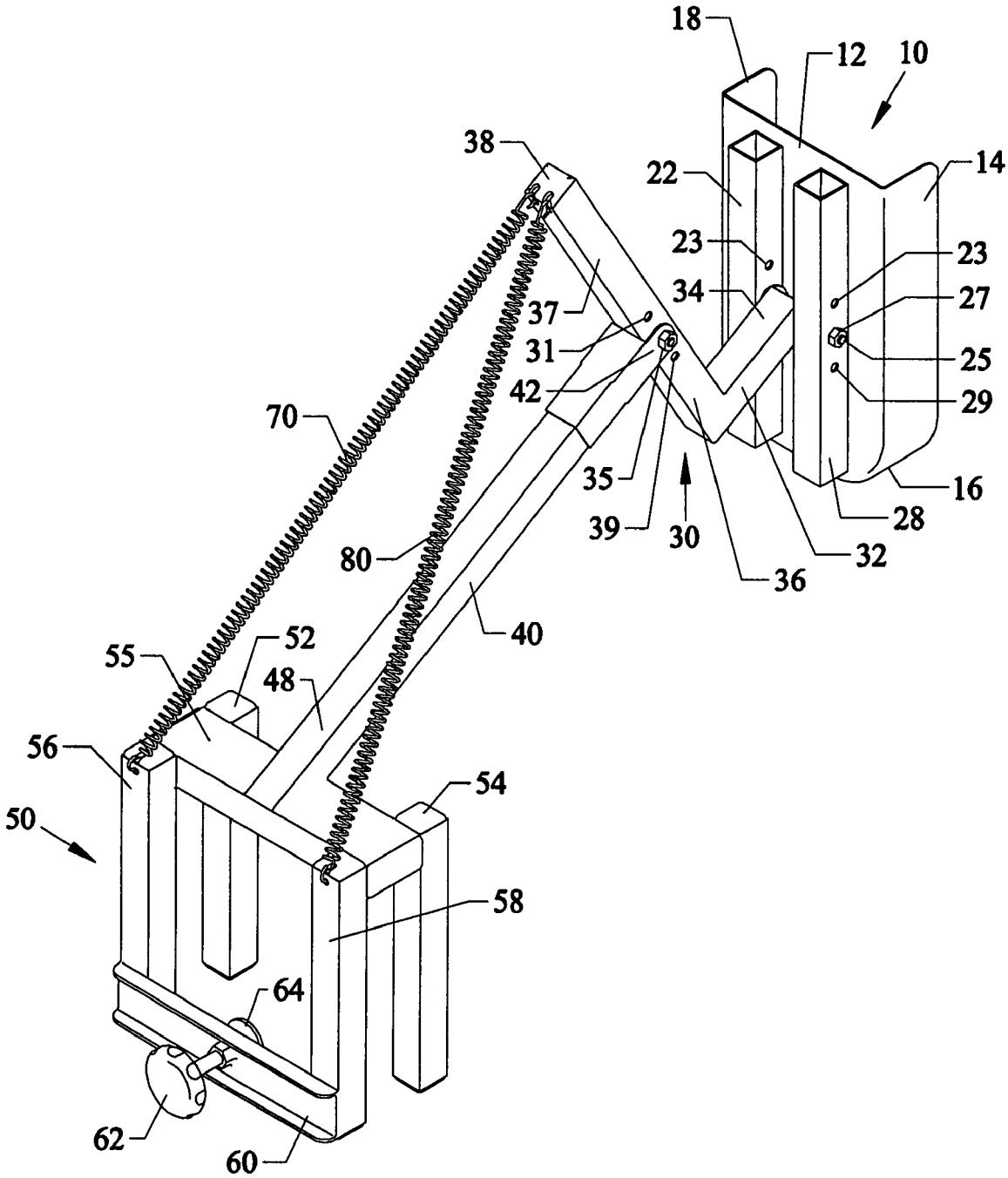
FIG. 2 is a perspective rear clamp side view of the device of FIG. 1.
Figure 3:
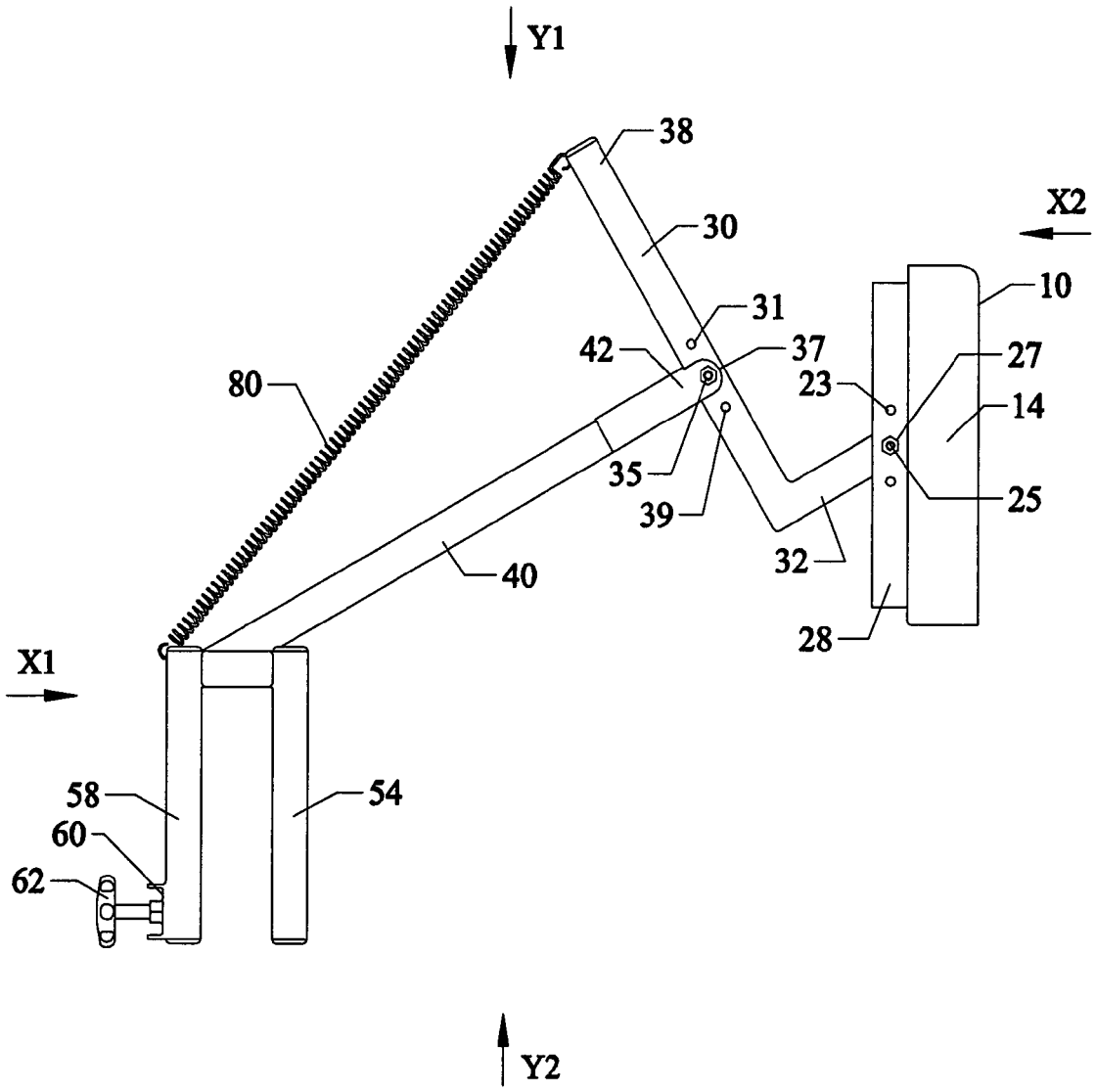
FIG. 3 is a side view of the device of FIG. 1.
Figure 4:
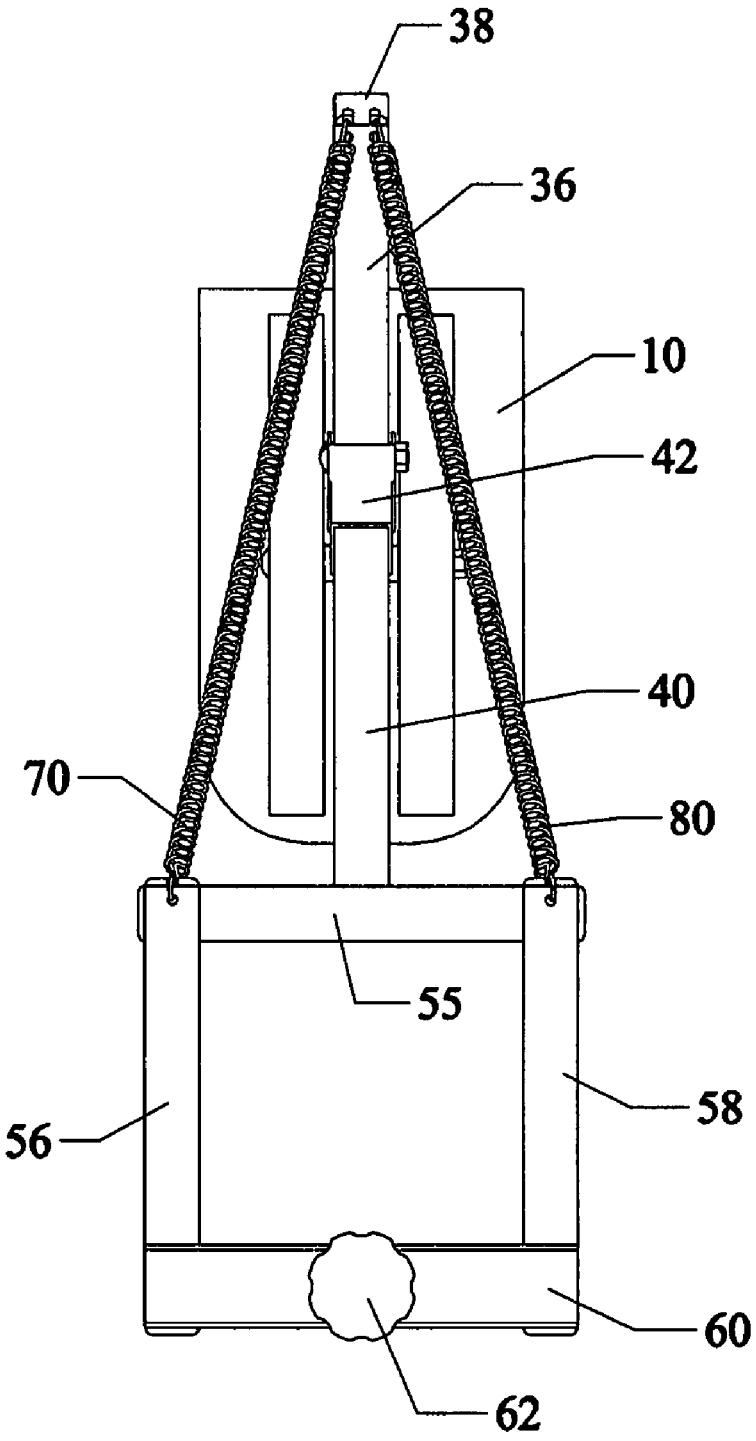
FIG. 4 is a rear end view of the device of FIG. 3 along arrow X1.
Figure 5:
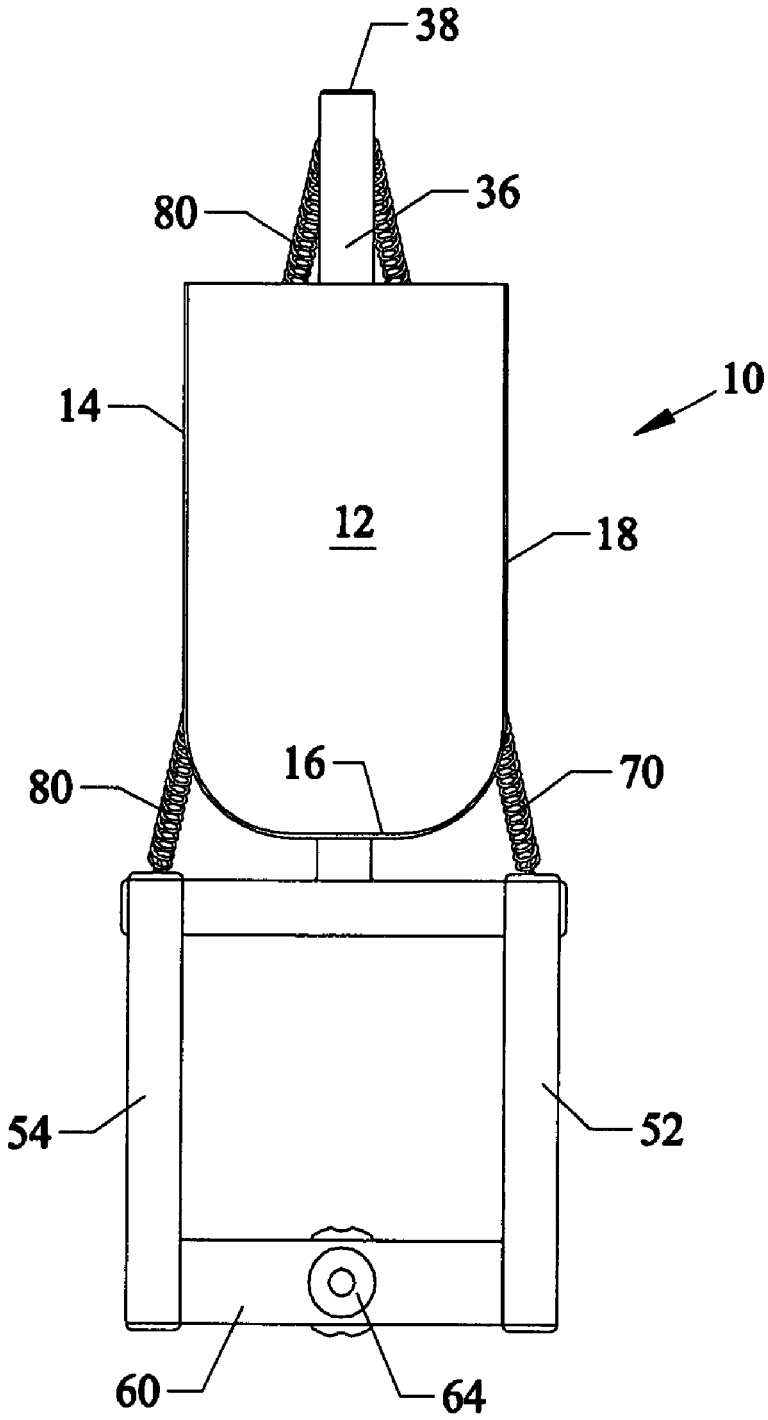
FIG. 5 is a front end view of the device of FIG. 3 along arrow X2.
Figure 6:
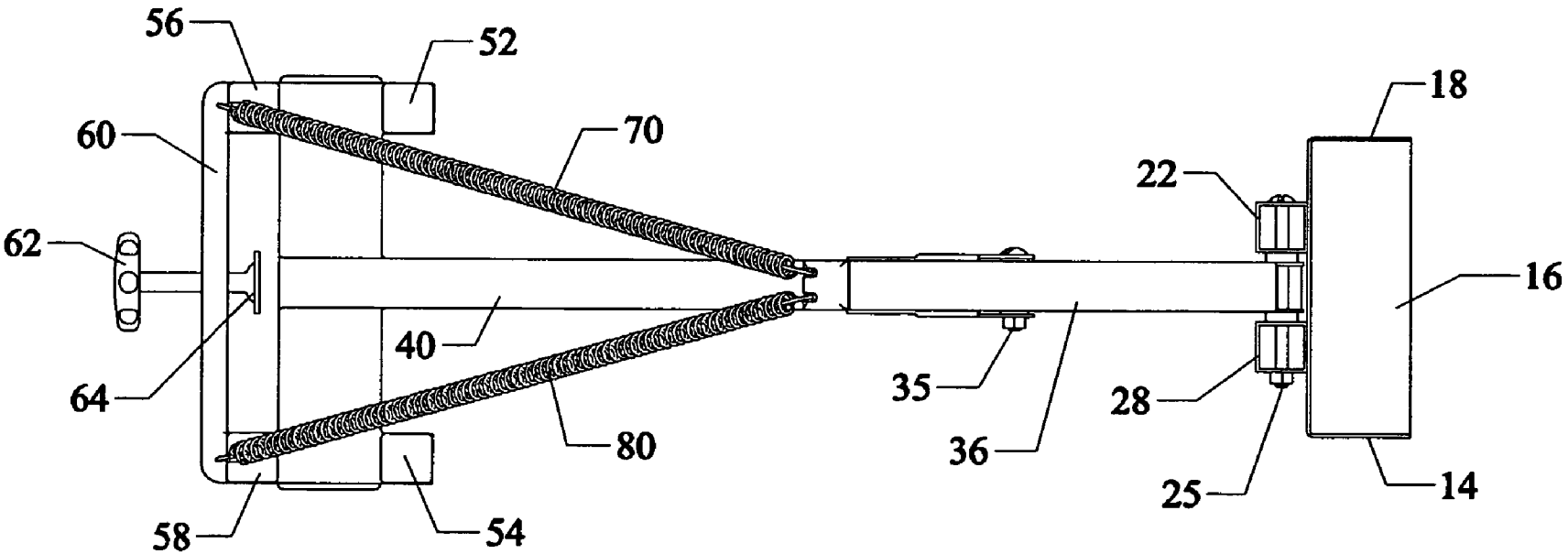
FIG. 6 is a top view of the device of FIG. 3 along arrow Y1.
Figure 7:
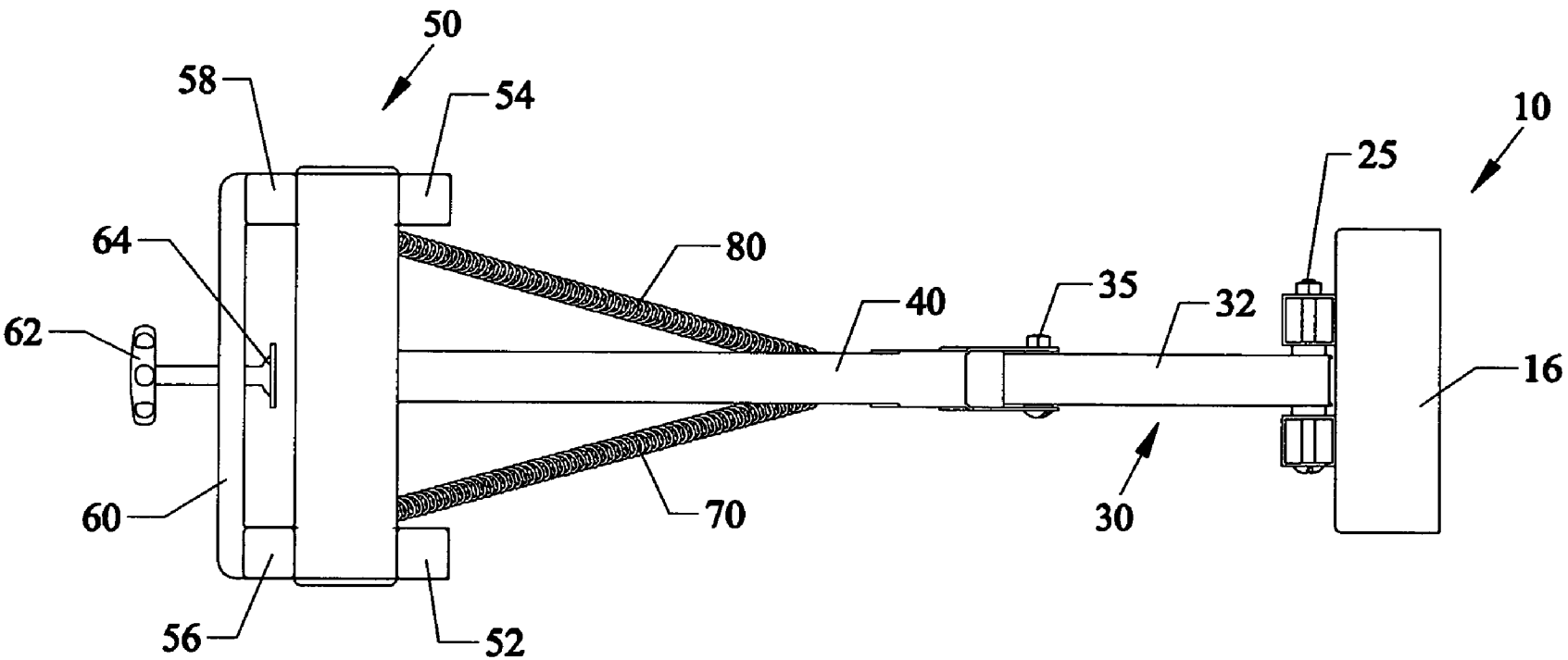
FIG. 7 is a bottom view of the device of FIG. 3 along arrow Y2.

FIG. 1 is a perspective front footpad side view of the exercise and therapy device. FIG. 2 is a perspective rear clamp side view of the device of FIG. 1. FIG. 3 is a side view of the device 1 of FIG. 1. FIG. 4 is a rear end view of the device 1 of FIG. 3 along arrow X1. FIG. 5 is a front end view of the device 1 of FIG. 3 along arrow X2. FIG. 6 is a top view of the device 1 of FIG. 3 along arrow Y1. FIG. 7 is a bottom view of the device 1 of FIG. 3 along arrow Y2.

Referring to FIGS. 1-7, a preferred embodiment of the device 1 can include a cradle/footpad 10 pivotally attached to a spring biased backward L-shaped bar, which is pivotally attached to an angled elongated member 40 that protrudes from a clamp 50 that is attached to support members, such as footboards or headboards which will be discussed further below. The main components can be formed from rigid metal such as but not limited to galvanized steel, and the like, with metal springs.

The cradle/footpad 10 can include a base plate 12, with left sidewall 14, right sidewall 18, and bottom curved wall 16 therebetween. On the back of cradle/footpad 10 can be mounted by welding, and the like, a first cradle bracket 22 and a second cradle bracket 26 spaced apart from and parallel to one another. On the first and second cradle brackets 22, 28 can be plural mounting holes that can include a pair of cradle back upper mounting holes 23, a pair of cradle back middle mounting holes 27, and a pair of cradle back lower mounting holes 29. A pivoting bar with fasteners 25, such as a screw and nut, can attach the outer end 34 of the bottom side leg 36 of the backward L shaped bar 30 to the first and second cradle brackets 22, 28.

The backward L-shaped bar 30 can be pivotally attached to a pair of protruding flanges 42 of angled elongated member 40 by pivoting fastener 35 such as a screw and nut, that is inserted through different located throughholes 31, 37, 39.

A first spring 70 and a second spring 80 can attach the upper end 38 of side leg 36 to respective upper ends of the rear pair of downwardly protruding clamp members 56, 58. The springs 70, 80 can biasly hold the upper end 38 of the pivotable backward L-shaped bar 30 toward the clamp 50, so that pushing against base plate 12 of footpad 10 stretches the springs 70, 80.

Clamp 50 can include a top cap portion 55 with the elongated member 40 protruding from an angle therefrom. The clamp can include a front pair of downwardly protruding members 52, 54 and a rear pair of downwardly protruding members 56, 58 for mounting about a support such as a bed headboard or bed footboard, which will be discussed in greater detail below. A clamp bar bracket welded to lower out ends of the rear pair of downward protruding members 56, 58 can have a turn knob 62 that when tightened pushes a screw head 64 against the support that will be described below.

Adjustment of the device to modify spring biasing, torque and/or comfort will now be described in reference to FIGS. 1-7 for both the footpad 10 and the backward L-shaped bar 30. Locating the pivoting fastener 35 through the lower throughhole 39 causes the user to exert greater amounts of pressure to push against the footpad 10 than locating the pivoting fastener in throughholes 31 and 37. Locating the pivoting fastener 35 in upper throughhole 31 allows the user to use the least amount of pressure since it allows for the largest amount of leverage to push against footpad 10 and stretch springs 70, 80.

Further adjustment of the device 1 can be described by the different mounting positions of the backward L-shaped bar 30 to the outer end 42 of the elongated member 40. The pivoting fastening bar 25 can be inserted through any pair of the upper mounting holes 23, pair of middle mounting holes 27 or pair of lower mounting holes 29, depending on the user. Mounting through the lower pair of mounting holes 29 will allow the user to primarily use the heel of their foot to push against the spring biased backward L-shaped bar 30 as compared to mounting through the middle pair of mounting holes 27 or upper pair of mounting holes 23. Use of the middle mounting holes 27 and upper mounting holes 23 allow for the user's ankle to be able to exercised by the user having to push harder against the spring biased backward L-shaped bar 30. Also, user's with different sized feet can customize their fit by theusing the different mounting hole pairs 23, 27, 29.

Figure 8:
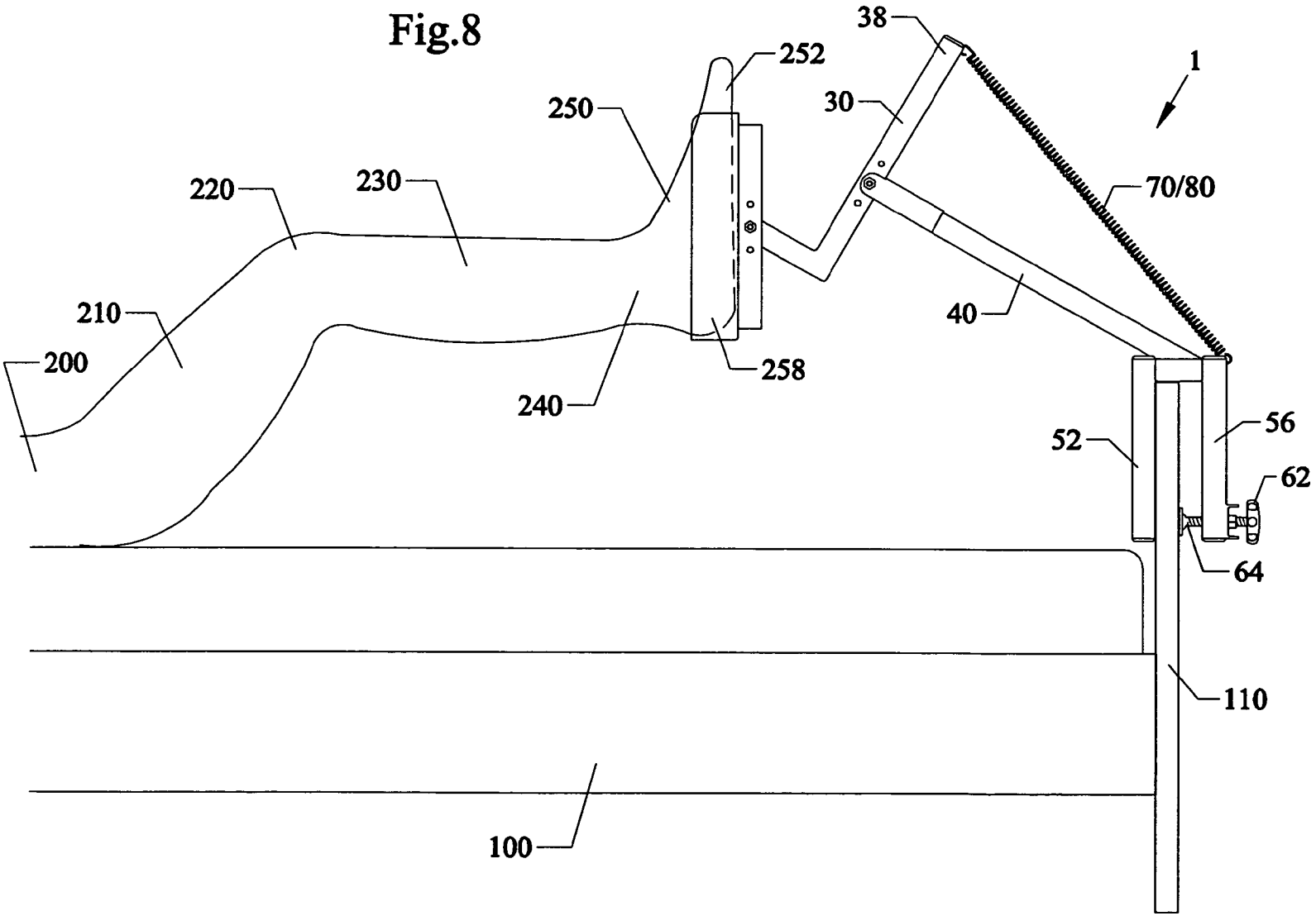
FIG. 8 is a side view of the device of the preceding figures clamped to a bed board, and a user about to use the device.
Figure 9:
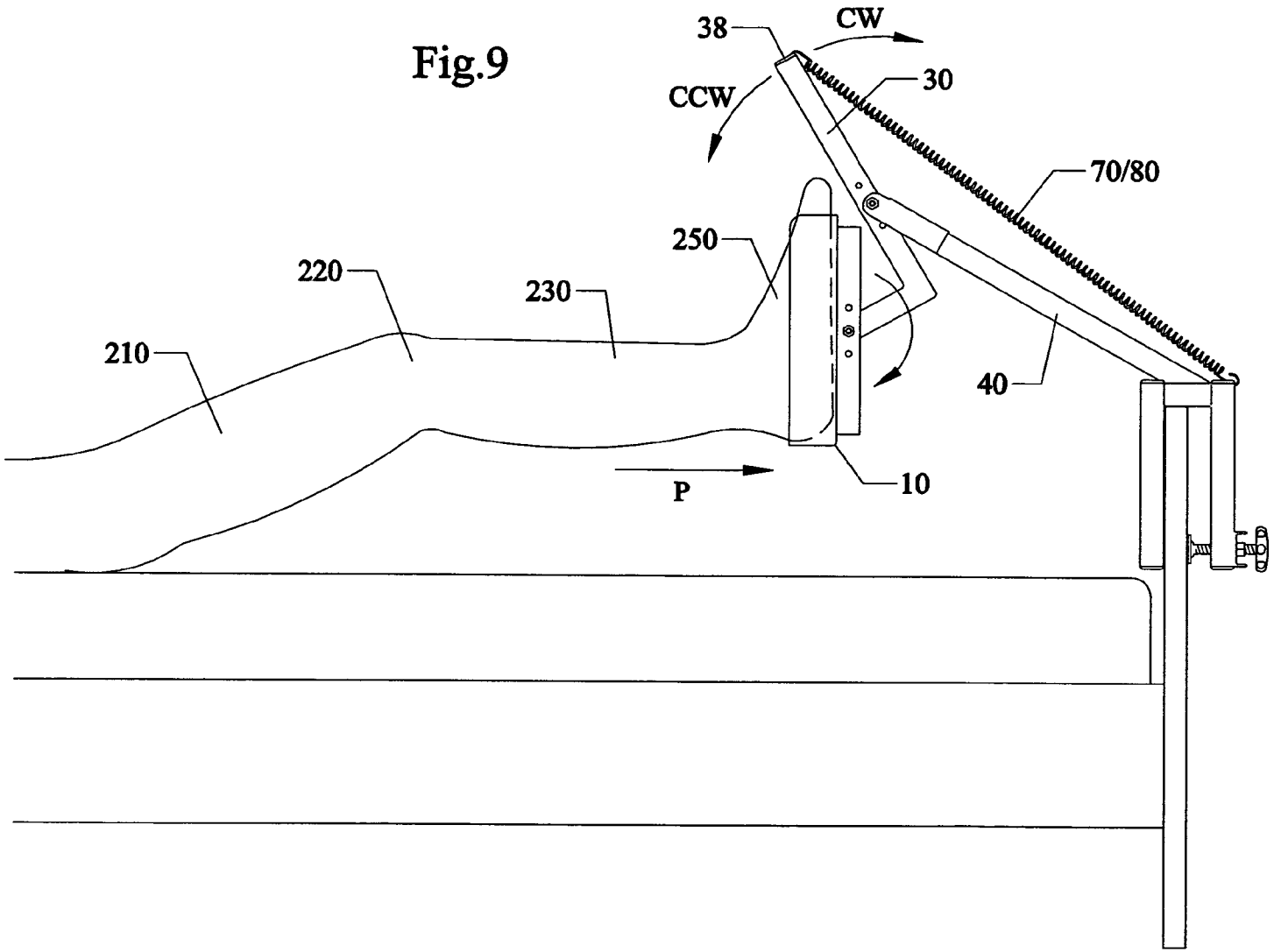
FIG. 9 is another view of the device and user of FIG. 8 after the user stretches their leg.
Figure 10:
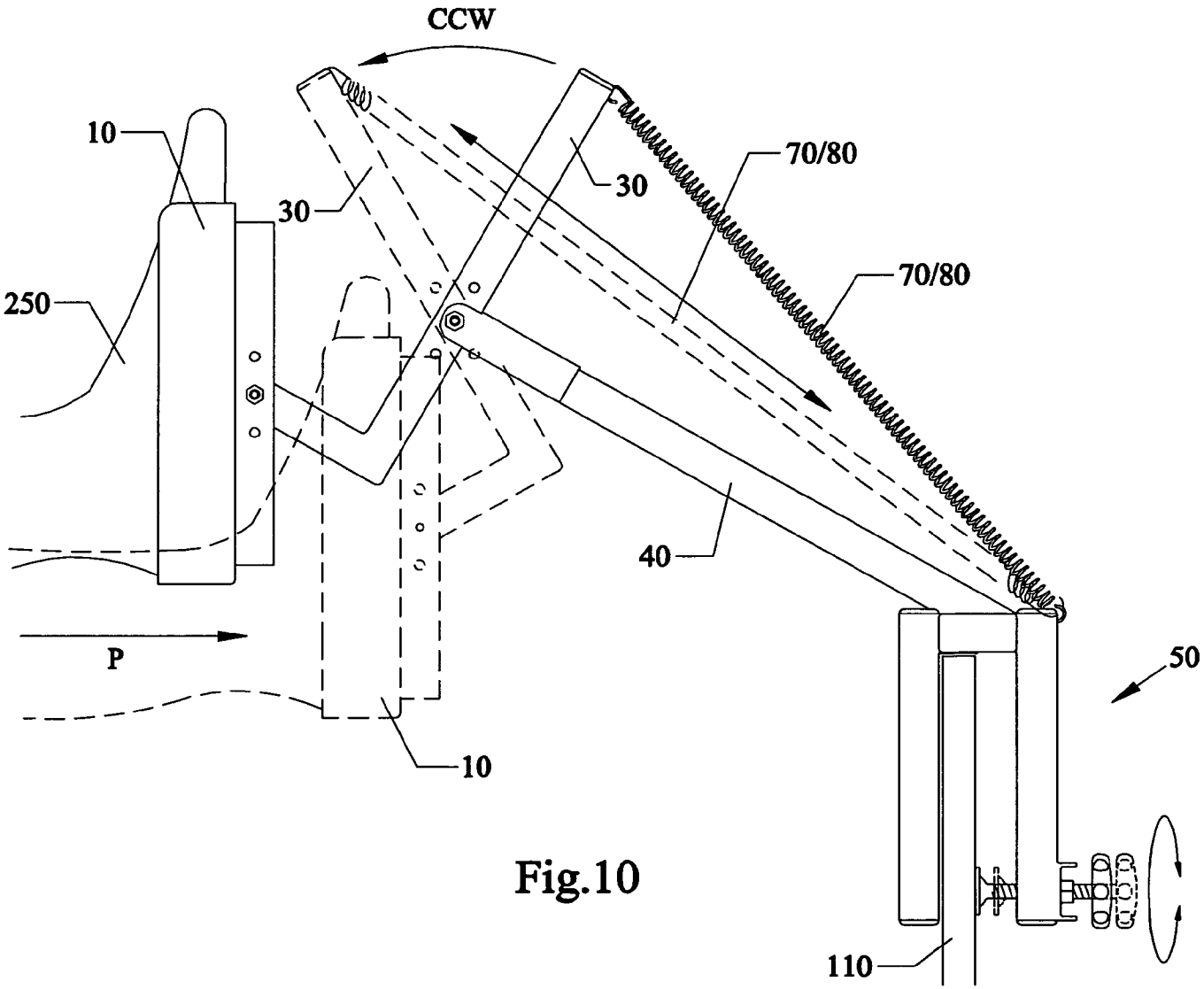
FIG. 10 is an enlarged view of a user's foot pivoting the L-shaped bracket of the device.

FIG. 8 is a side view of the device 1 of the proceding figures clamped to a footboard/headboard 110 of a bed 100, and a user 200 about to use the device 1. FIG. 9 is another view of the device 1 and user 200 of FIG. 8 after the user stretches their leg 210, 230. FIG. 10 is an enlarged view of a user's foot 250 pivoting the L-shaped bracket 30 of the device 1.

Referring to FIGS. 1-10, a preferred application is to attach the device 1 by slipping the front pair of downwardly members 52, 54 and the rear pair of downwardly protruding members about a headboard/footboard 110 of a bed. The device can be fixably mounted in place by rotatably tightening a turn knob 62 that presses a screw head 64 against one side of the headboard/footboard 110. Next a user/patient can be positioned to lay on their back on a bed 100, with one of their feet 252 placed in the cradle/footpad 10 so that the lower sole of their foot rests against the base plate 12 and is held in place by sidewalls 14, 16 and 18 of the cradle 10. The user 200 can initially as shown in FIG. 8 have their upper leg 210 raised and bent at the knee 220 to lower leg 230.

Next, the user can push outward in the direction of arrow P straightening out their upper leg 210 to their lower leg 230 as shown in FIG. 9. Here, the backward L-shaped bracket 30 can pivot relative to elongated member and rotate counter-clockwise in the direction of arrow CCW, and stretch springs 80/70. Increasing the tension on springs 70/80 can provide exercise and therapy along the muscles and joints of upper leg 210, knee 220 and lower leg 230. Pumping the leg back and forth allows for further exercise and therapy to occur as shown in FIG. 10 so that the L-shaped member 30 moves clockwise in the direction of arrow CW as well as counter clockwise in the direction of arrow CCW.

FIG. 11A is an enlarged view of a foot tip 252 pushing forward pivoting the device footpad 10. FIG. 11B is an enlarged view of a foot bottom/heal 258 pushing forward pivoting the footpad 10. Referring to FIGS. 11A-11B, the foot 250 and ankle 240 can be further exercised as the same time or separate from the upper leg 210, the knee 220 and the lower leg 230. At the same time or separately, the user 200 can further rotate their foot 250 relative to their ankle 240 by pivoting footpad 10 relative to the backward L-shaped bar 30 by rotating in the clockwise direction of arrow CW or in the counter clockwise direction of arrow CCW.

Figure 12A:
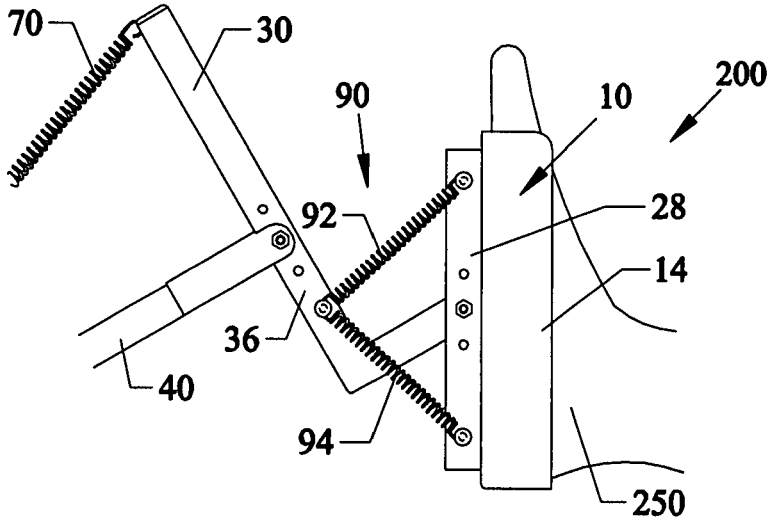
FIG. 12A is a side view of another embodiment of the device with extra spring(s) for the pivoting footpad with supported foot.
Figure 12B:
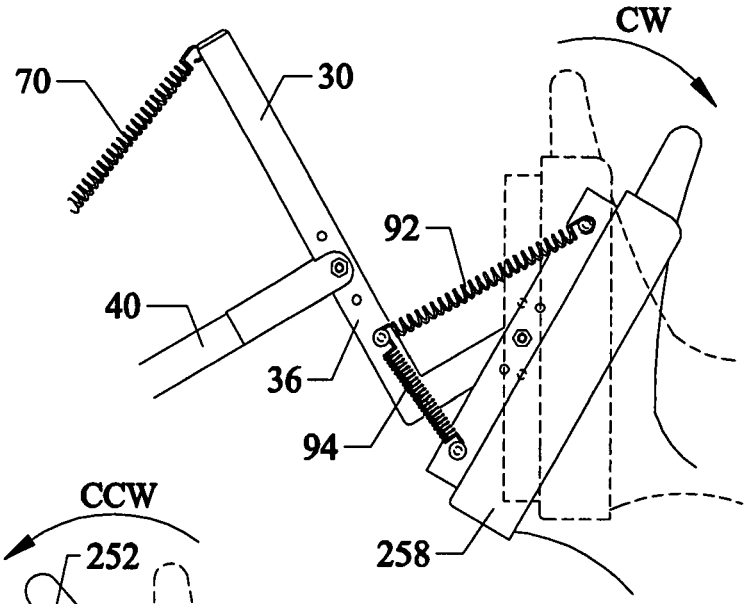
FIG. 12B is the foot bottom of FIG. 12A pushing forward against a spring biased footpad.
Figure 12C:
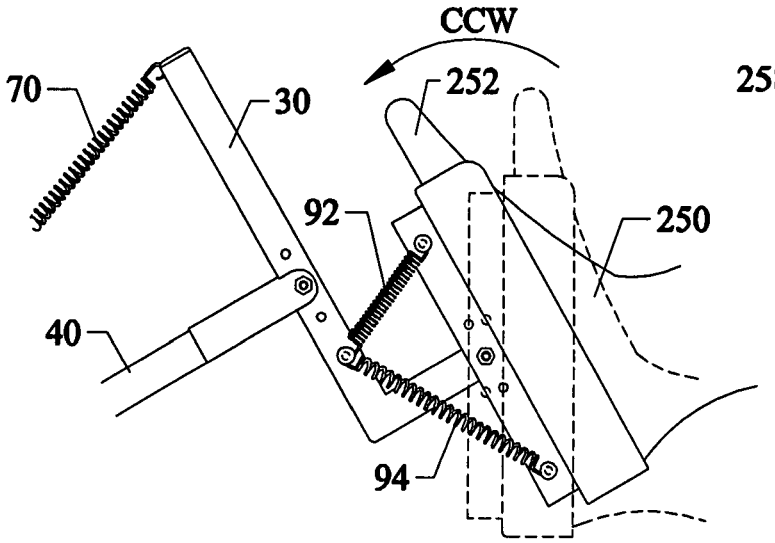
FIG. 12C is the foot top of FIG. 12A pushing forward against the spring biased footpad.

FIG. 12A is a side view of another embodiment 200 of the device 1 of the proceding figures with extra spring(s) 90 for the pivoting footpad 10 with supported foot 250. FIG. 12B is the foot heel 258 of FIG. 12A pushing forward against a spring biased footpad 10. FIG. 12C is the foot top/tip 252 of FIG. 12A pushing forward against the spring biased footpad 10. Here, an upper spring 92 can attach upper portions of the foot pad 10 to the side leg 36 of the backward L-shaped bar 30, and lower spring 94 can attach the lower portion of the foot pad 10 to the side leg 36 of the backward L-shaped bar 30. Pushing the foot heel 258 can rotate foot pad 10 in the direction of arrow CW relative to L-shaped bar 30 and stretch spring 92. Pushing the toe tip 252 outward can rotate foot pad 10 in the direction of arrow CCW and stretch spring 94. The alternative pushing of the foot tip 252 and foot heel 258 can provide exercise to the foot 250, and ankle 240. More springs and/or less springs can be added to adjust the tension and pressure of the device 1 as needed.

A prototype of the invention was tested with a patient that had been in a severe automobile accident that resulted in the patient's pelvis being totally crushed and not possible to pin, screw otherwise secure the pelvis. The patient's ankle was also fractured in approximately eight places. The doctors had advised that by the time the pelvis was sufficiently healed for the patient to stand, the ankle would have been frozen, and the patient would end up walking with a frozen(stiff) ankle. The patient used the prototype while sitting and reclining on a bed with the prototype attached to the bed footboard. Over a period of time of several months of using the prototype and following a repertoire of self therapy by pushing on the foot pad and rotating their ankle, the patient now walks normally with their foot having free unlimited rotation about their ankle.

Although the invention is described as having three sets of mounting holes on the back of the footpad and the backward L-shaped bar, more or less mounting holes can be used as desired to adjust the tension and pressure levels of using the device.

While the preferred embodiment is described being formed from metal components, the invention can be formed from other components such as rigid plastic, and the like, and/or combination of metal and plastic.

Although the invention is shown and described having the user laying on a bed, the invention can be used with the patient sitting on a chair, a sofa spaced away from a mounted invention, wherein the invention can be mounted off the frontboard of the bed.

While the invention has been described, disclosed, illustrated and shown in various terms of certain embodiments or modifications which it has presumed in practice, the scope of the invention is not intended to be, nor should it be deemed to be, limited thereby and such other modification or embodiments as may be suggested by the teachings herein are particularly reserved especially as they fall within the breadth and scope of the claims here appended.

I claim:

1. A therapy and exercise device, consisting essentially of:

a foot pad having a flat surface adapted for fitting against a bottom of a foot, the foot pad having an upper edge and a lower edge, the foot pad having raised side edges substantially perpendicular to the flat surface adapted for keeping the foot on the flat surface;

an L-shaped bar having an upper end, a bottom end with an upwardly angled lower leg and outer end, and a mid-portion between the upper end and the bottom end, a rear portion of the footpad being pivotally attached to the outer end of the upwardly angled leg of the L-shaped bar, so that while the upper edge of the foot pad pivots toward the upper end of the L-shaped bar, the lower edge pivots away from the L-shaped bar, and while the upper edge of the foot pad pivots away from the upper end of the L-shaped bar, the lower edge pivots toward the L-shaped bar;

a clamp adapted for clamping over a top edge of a raised support member, the raised member being selected from one of a headboard and a footboard of a bed;

an elongated member having a first end fixably attached to the clamp and a second end opposite to the first end, wherein the mid-portion of the L-shaped bar is pivotally attached to the second end of the elongated member; and a pair of springs, the spring having upper ends and lower ends, the upper ends of the springs being attached to the upper end of the L-shaped bar the lower ends of the springs being attached to a portion of the clamp that is adjacent to the first end of the elongated member, wherein the lower ends of each of the springs are attached to locations on the clamp that are on opposite sides of the first end of the elongated member, and wherein a person lying on the bed is able to put one of their feet against the flat surface of the foot pad and provide therapy and exercise to their leg and their foot.

2. A therapy and exercise system for beds, consisting essentially of:

a bed having a raised end, the raised end being selected from at least one of a footboard and a headboard, the bed adapted for allowing an occupant to lay thereon;

a foot pad having a flat surface adapted for fitting against a bottom of a foot of the laying occupant, the foot pad having an upper edge and a lower edge, the foot pad having raised side edges substantially perpendicular to the flat surface adapted for keeping the foot on the flat surface;

an elongated L-shaped bar having an upper end, a bottom end and a mid-portion therebetween, an upwardly angled lower leg attached to the bottom end of the elongated L-shaped bar, the upwardly angled lower leg having an outer end portion, the footpad having a rear portion that is pivotally attached to the outer end portion of the upwardly angled lower leg of the elongated L-shaped bar, so that while the upper edge of the foot pad pivots toward the upper end of the elongated L-shaped bar, the lower edge pivots away from the L-shaped bar, and while the upper edge of the foot pad pivots away from the upper end of the elongated L-shaped bar, the lower edge pivots toward the L-shaped bar;

a clamp adapted for clamping over a top edge of a raised support member, the raised support member being selected from one of a headboard of a bed and a footboard of a bed;

an elongated member having a first end fixably attached to the clamp and a second end opposite to the first end, wherein the mid-portion of the L-shaped elongated bar is pivotally attached to the second end of the elongated member; and a pair of springs, the springs having outer ends and inner ends, the outer ends of the springs for being attached to the upper end of the L-shaped elongated bar, the inner ends of the springs being attached to a portion of the clamp that is adjacent to the first end of the elongated member, wherein the inner ends of each of the springs are attached to locations on the clamp that are on opposite sides of the first end of the elongated member, wherein the system is adapted for allowing the occupant to exercise their ankle, foot and leg by pushing on the pivotal foot pad which also allows the bar to pivot against the elongated member while the spring pushes back against the foot.

* * * * *